US005669076A

United States Patent [19]

Steffy

[11] Patent Number: 5,669,076

[45] Date of Patent: Sep. 23, 1997

[54] ADJUSTABLE SIZE SELECTABLE PIE HAT

[75] Inventor: Sharon L. Steffy, Reinhold, Pa.

[73] Assignee: Bollman Hat Company, Lancaster, Pa.

[21] Appl. No.: 608,064

[22] Filed: Feb. 28, 1996

[51] Int. Cl.[6] ..... A42B 1/22

[52] U.S. Cl. ..... 2/195.2; 2/183

[58] Field of Search ..... 2/171, 171.4, 171.5, 2/171.6, 171.7, 171.8, 183, 195.2, 417, 418, 420

[56] References Cited

U.S. PATENT DOCUMENTS

| | | |
|---|---|---|
| 1,262,409 | 4/1918 | Tim . |
| 1,513,682 | 10/1924 | Weinstein . |
| 2,406,701 | 2/1946 | Miller . |
| 2,775,769 | 1/1957 | Henschel . |
| 2,889,558 | 6/1959 | Feldman . |
| 3,396,408 | 8/1968 | Enger . |
| 3,465,366 | 9/1969 | Topiel . |
| 3,737,918 | 6/1973 | Henschel . |
| 4,011,600 | 3/1977 | Malk . |
| 4,023,212 | 5/1977 | Huffman . |
| 4,101,981 | 7/1978 | Boden . |
| 4,815,148 | 3/1989 | Satterfield . |
| 5,025,505 | 6/1991 | Fekete, Sr. . |

FOREIGN PATENT DOCUMENTS

| | | |
|---|---|---|
| 1259571 | 3/1960 | France . |
| 1400477 | 4/1964 | France . |
| 1019556 | 1/1963 | United Kingdom . |
| 1113788 | 5/1968 | United Kingdom . |
| 1273740 | 5/1972 | United Kingdom . |

*Primary Examiner*—Diana Biefeld

*Attorney, Agent, or Firm*—Shlesinger Arkwright & Garvey, LLP

[57] ABSTRACT

This invention relates to an adjustable size selectable pie hat which is provided with means in the back of the hat to permit the hat to be adjusted for different sizes without causing bulging in the appearance in the hat at the back.

22 Claims, 3 Drawing Sheets

ADJUSTABLE SIZE SELECTABLE PIE HAT

FIELD OF THE INVENTION

This invention pertains to hats known in the trade as pie hats due to the manufacturing of the hats with segments so as to give the appearance of a baked pie in which the slices have been cut. The adjustment features allows for a neat looking hat at any size adjustment.

BACKGROUND OF THE INVENTION

In the past, adjustable caps and hats have been manufactured with different types of adjustability at the back including the use of VELCRO®, hook and loop fasteners, as an adjustable securing feature. For many years, there has been an objection to the appearance of adjustable caps of the pie type provided with an adjustment slit in the back because of the bunching or bulging at the slit. Sadderfield U.S. Pat. No. 4,815,148, French patent of Lacoste 1,259,571, Tim U.S. Pat. No. 1,262,409, Weinstein U.S. Pat. No. 1,513,682, British Patent to Jones 1,019,556, Huffman U.S. Pat. No. 4,023,212 and Boden U.S. Pat. No. 4,101,981 disclose rear adjustable features for pie hats with the problem of bunching, wrinkling, and bulging at the slit when the hat is adjusted. None are ordinarily used for expensive high fashion hats requiring a neat smooth and attractive appearance in the back.

OBJECTS AND SUMMARY OF THE INVENTION

It is an object of this invention to provide a pie hat which is adjustable and at the same time neat in appearance in any size to which it has been adjusted.

Still a further object of this invention is to provide a pie hat which is easy and inexpensive to manufacture.

A further object of this invention is to provide a pie hat which is comfortable in adjustment without causing the wearer undue pressure at the point of adjustment.

Still a further object of this invention is to provide an adjustable feature for a pie hat which is attractive under adjustment to the more discriminating purchaser.

A further object of this invention is to provide a pie hat which is easily adjusted by the wearer.

In summary, the present invention pertains to a pie hat which has an adjustable feature which will keep the hat neat looking under any size change. These and other objects of the invention will be apparent from the following:

DESCRIPTION OF THE DRAWINGS

FIGS. 1 THROUGH 6

In FIG. 1, the hat H includes a brim B, a sweatband S and adjustment means A as generally shown in FIG. 1.

Figure 1:
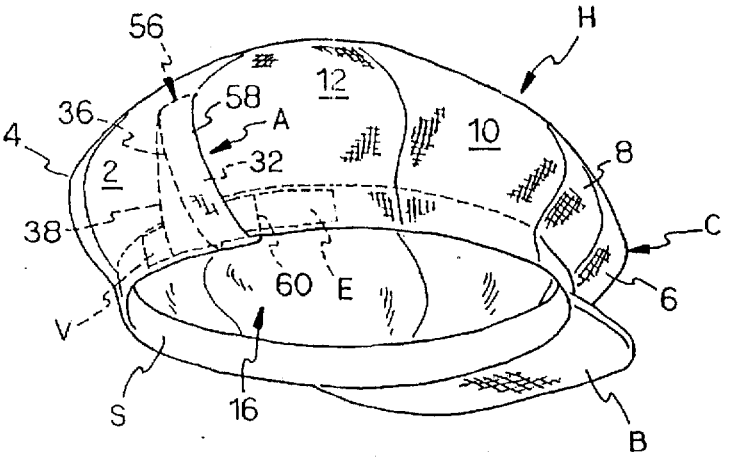
FIG. 1 is a perspective view of the cap as worn with hidden portions shown in broken lines.
Figure 5:
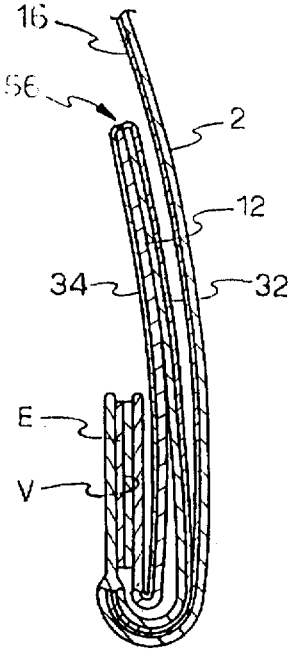
FIG. 5 is a cross sectional view taken along the lines 5—5 of FIG. 3 and viewed in the direction of the arrows.

The hat H may be constructed of fabric including synthetic and natural materials. As noted in the FIGS. 1–6, the upper portion of the hat H consist of a crown C. The crown C is formed by a series of segments such as 2, 4, 6, 8, 10, 12. The segments on the far side of the hat as viewed in the drawings are not numbered. Segments 2 and 12 form a pair of adjacent segments at the rear of the hat H.

Figure 2:
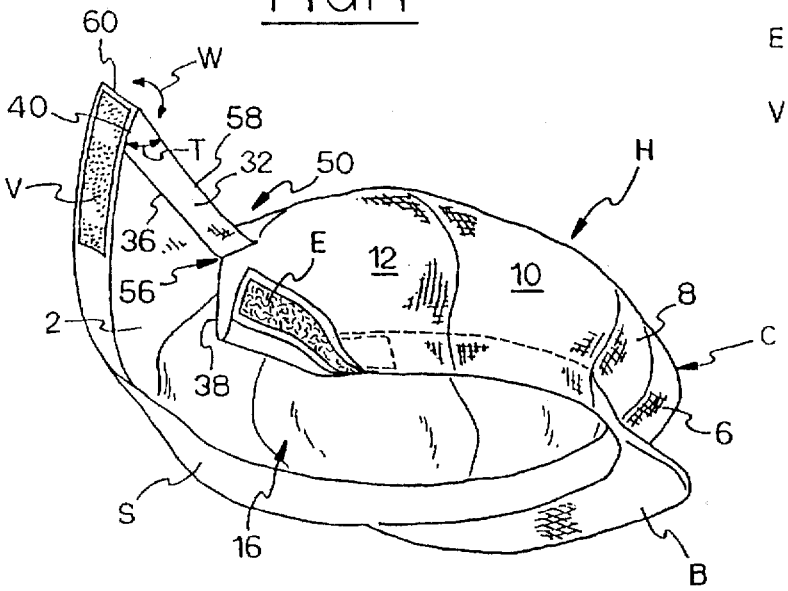
FIG. 2 is a perspective view of the cap prior to the adjustment means being connected with portions shown in broken lines.

The sweatband S includes a VELCRO®, hook and loop fasteners system generally consisting of a loop piece V and a hook piece E. In FIG. 2 the hook piece V is secured to the sweatband S at one end and the loop piece E is secured to the sweatband S at the other end. Obviously the 2 VELCRO®, hook and loop fasteners, pieces V and E can be reversed if desired.

Figure 10:
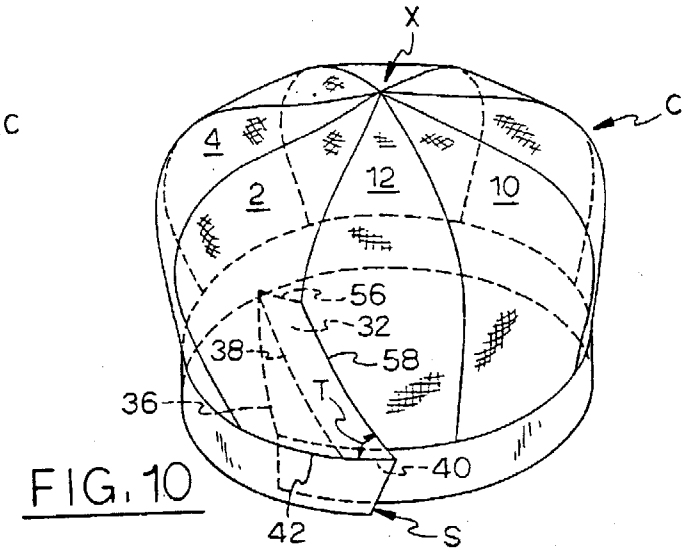
FIG. 9 and 10 shows first and second positions of adjustment of the hat in outline with portions shown hidden in broken lines.
Figure 9:
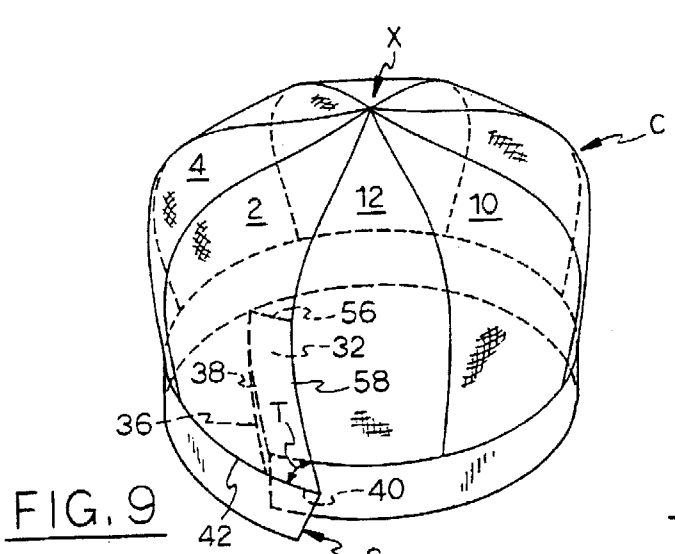

Each of the segments 2–12 and those others not indicated by numbers have an apex X as generally indicated in FIGS. 9 and 10.

Figure 3:
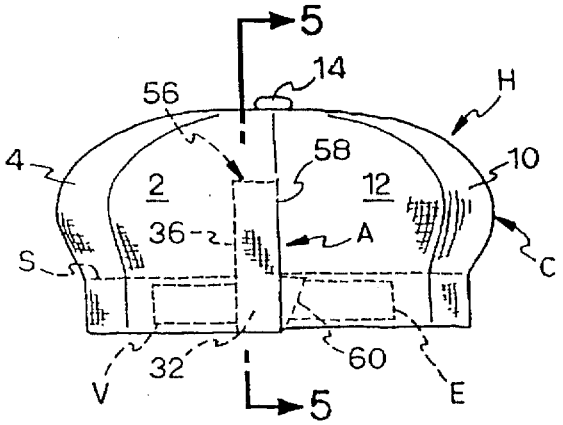
FIG. 3 is a rear elevation view of the cap with portions shown in broken lines indicating a first adjusted position for a head size.
Figure 4:
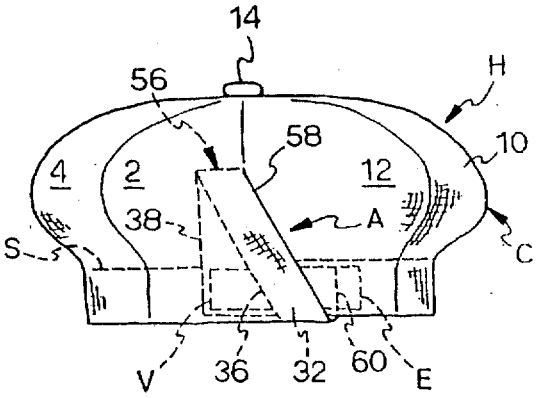
FIG. 4 is a rear elavational view of the cap portions being shown in broken lines and adjusted for a different head size from FIG. 3.
Figure 6:
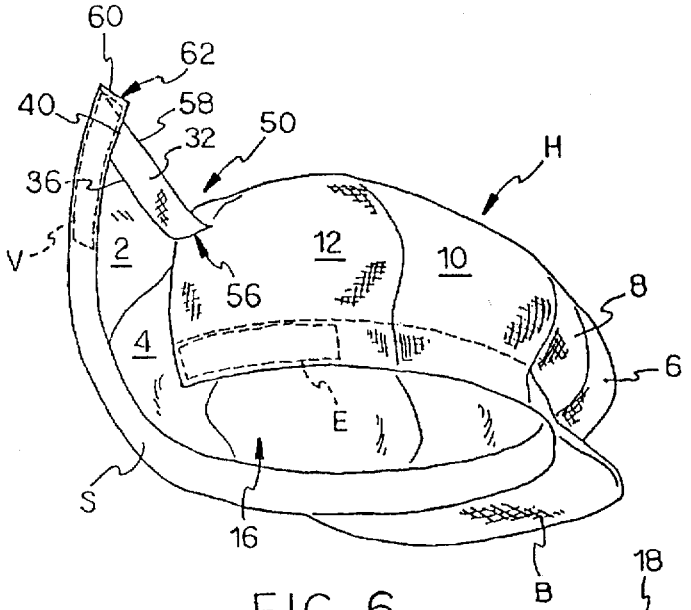
FIG. 6 is a perspective view of the cap opened at the rear.

As illustrated in FIGS. 3 and 4, a button 14 is sewn to the apexes X of the segments 2, 4, 6, 8, 10, 12 etc. In FIGS. 1, 2 and 6, lining 16 is provided. The lining may be constructed of segments similar to the segments 2, 4, 6, 8, 10, 12 etc. For more expensive hats H, the lining 16 is required. However, the lining 16 may be eliminated as desired.

FIGS. 7 AND 8

Figure 7:
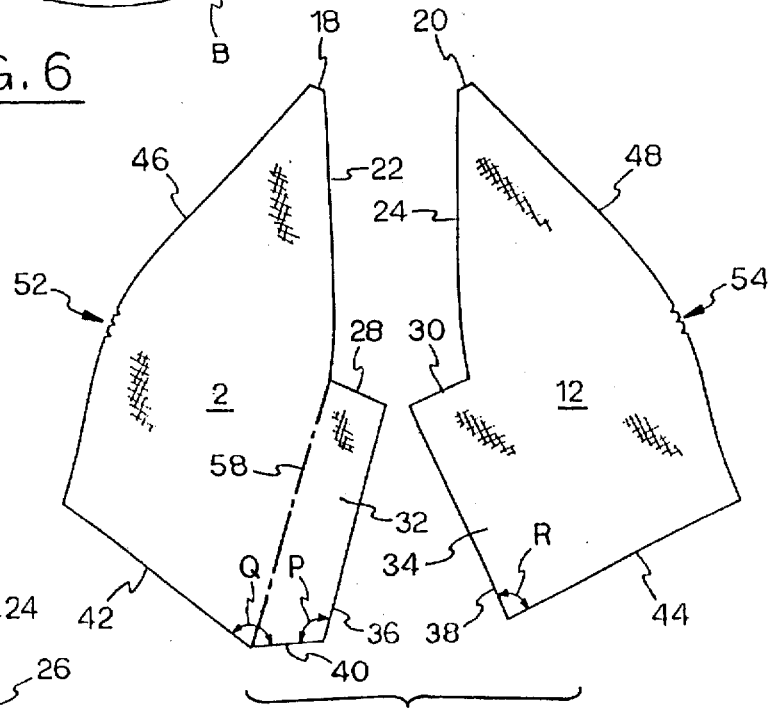
FIG. 7 shows the position of the rear adjacent segments prior to stitching.
Figure 8:
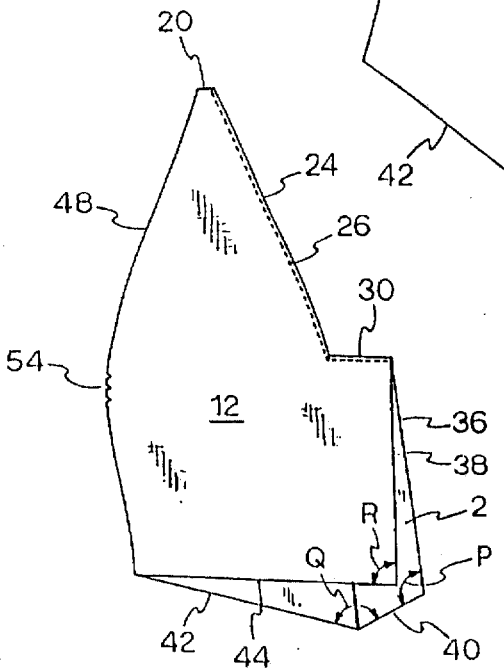
FIG. 8 shows the rear segments after stitching.

As shown in FIGS. 7 and 8, the rear segments 2 and 12 of the crown C cooperate with each other and are designed to form the adjustment means A.

Segment 2 has an apex 18 and segment 12 has an apex 20. Sides 22 and 24 are shown stitched together in FIG. 8 by stitching 26 which extends a substantial distance down from the apex and goes at an obtuse angle along the top edges 28 and 30.

Segment 2 includes an outward extension 32 and segment 12 includes an outward extension 34. Extensions 32 and 34 are provided with side edges 36 and 38 respectively. Side edge 36 is notably longer than side edge 38 as shown in FIGS. 7 and 8. The edge 36 extends downwardly and meets a bottom edge 40 at an obtuse angle P. Bottom edge 40 forms the bottom of the outward extension 32 of the segment 2. The segment 2 includes an additional bottom long edge 42 which meets bottom edge 40 at an obtuse angle Q. Edge 38 of segment 12 meets the bottom edge 44 at substantially a right angle R. Sides 46 and 48 of segments 2 and 12 respectively are stitched to adjacent segments of the pie hat H going toward the front of the hat H. The flat or outward extensions 32 and 34 are free and not engaged to each other providing a fly opening 50 as best seen in FIG. 2. The fly opening 50 is secured by the adjustment means A which includes the VELCRO®, hook and loop fasteners, fasteners V and E as illustrated in FIGS. 1, 2, 3, 4, 5 and 6. The VELCRO® fasteners V and E commonly known as loop and hook fasteners permit adjustment of the size of the hat H by disengaging and moving one fastener with respect the other fastener E. It is to be noted that the hook and loop fasteners V and E are secured to the sweatband S. As desired, the fasteners V and E may be reversed in position and still function without any difficulty. Other type fasteners (not shown) can be used including spaced button holes and the like.

The segments 2 and 12 on the sides which are unstitched, include notches 52 and 54 respectively, which when stitched to their adjacent segments sides, (not shown) specifically allow for a greater flex at the area of bulge of the crown C as best shown in FIGS. 3 and 4.

FIGS. 9 and 10 are outlines showing the relationship of the various panels for larger or smaller heads.

It will now be noted that the stitching 26 along the sides 22 and 24 and the top edges 28 and 30 form a tuck 56 which allows for angulation of the outward extension or flap 32 with respect to the outward extension 34 permitting shifting of the adjustment means A to vary the size without creating a gap or bulge between the adjacent edges 34 and 36. This maintains the neat appearance of the back of the hat H at any desired size setting. Note in FIGS. 2 and 6 that the segment 2 angles formed by the edges 36 40 and 42 cooperate to permit the sweatband to shift easily during adjustment thus also permitting the segments 2 and 12 to lie flat against each other without gaps or wrinkling.

FIGS. 11 AND 12

Figure 12:
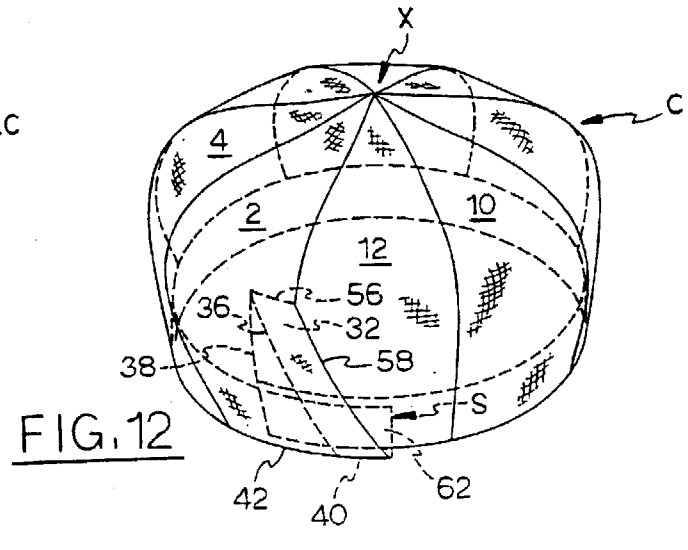
FIGS. 11 and 12 show an outline of the crown of the hat with the sweat band tucked under and showing portions in broken lines.
Figure 11:
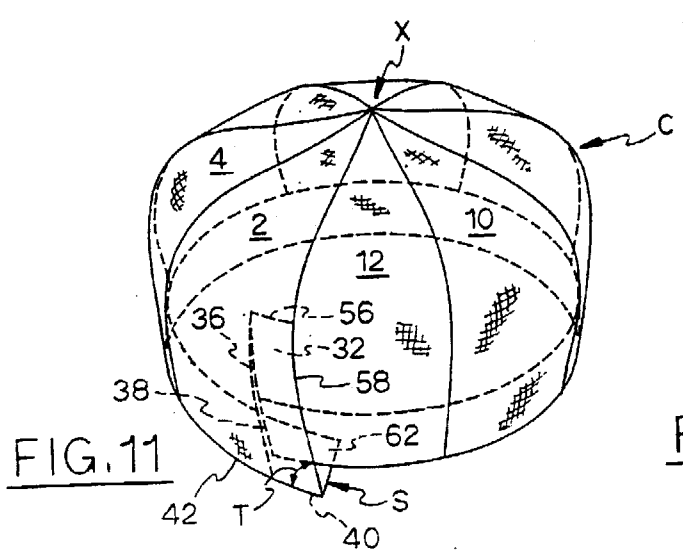

FIGS. 11 and 12 show in outline the crown C with the sweatband S secured thereto.

It should now be noted that when flap or extension 32 is folded along the line 58 as noted in FIGS. 7, 8, 9 and 10, an acute angle T is formed along the edge 42 meeting with the fold line 58. This now permits the flap extension 32 to move freely at the top thereof at the tuck 56. Note in FIG. 2 the acute angle T formed by the fold line 56 and the edges 40 and 42 of the segment 2. It should also be noted that the sweatband S where it is stitched to the edge 40 in the area of the VELCRO®, hook and loop fasteners, as best shown in FIGS. 2 and 6 has a side edge 60 which meets with the fold line 58 to form an obtuse angle W when the sweatband S is extended downwardly. When it is folded upwardly as illustrated in FIG. 6, an overlap 62 is formed between the outward extension or flap 32 and the side edge 60 of the sweatband S. This allows the lapping of the sweatbands by the hook and loop fasteners to overly one another evenly in linear arrangement keeping the lapping edges of the hat H with a minimum step overlap as best seen in FIGS. 3 and 4.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

This is having thus described my invention, what I claim is:

1. An adjustable size selectable pie hat having:

a) a crown having a front, a back, left and right sides, a center, and inside and outside surfaces, b) said crown including a series of interconnected segments, c) said segments each having an apex, sides and a base, d) said apexes of said segments meeting substantially at said crown center, e) said segments extending radially outward from said center of said crown, f) said crown back including a pair of adjacent segments having adjacent sides, g) each of said pair of segments having on their adjacent sides tuck forming means, h) said pair of segments connected to each other on their adjacent sides a substantial radial distance from their respective apexes to said tuck forming means and including said tuck forming means thereby forming a tuck, i) said pair of adjacent segments being disconnected from said tuck to their respective bases, j) means for adjustably securing said bases of said pair together to provide an overlap by said one of said pair of segments with the other of said pair of segments from said tuck to said bases of each pair, k) whereby when said bases are secured together for a selected size by said means for adjustably securing, said tuck will cause said overlap to lie flat and neat without bulge for said selected size regardless of size selected.

2. An adjustable size selectable pie hat as in claim 1 and wherein:

a) said hat includes a brim secured to said crown front.

3. An adjustable size selectable pie hat as in claim 2 and including:

a) a sweat band secured to said crown segments at said segment bases.

4. An adjustable size selectable pie hat as in claim 3 and wherein:

a) said adjustable securing means are hook and loop fasteners.

5. An adjustable size selectable pie hat as in claim 4 and wherein:

a) said hook and loop fasteners are secured to said sweatband.

6. An adjustable size selectable pie hat as in claim 3 and including:

a) a segmented liner for said crown.

7. An adjustable size selectable pie hat as in claim 1 and wherein:

a) said tuck lies against said inside surface of said crown.

8. An adjustable size selectable pie hat as in claim 7 and wherein:

a) said segments are interconnected by substantial radial stitching.

9. An adjustable size selectable pie hat as in claim 8 and wherein:

a) said tuck has stitching lying at an angle to said radial stitching of said segments when said tuck is lying against the inside surface of said crown.

10. An adjustable size selectable pie hat as in claim 9 and where in:

a) said angle is substantially an obtuse angle.

11. An adjustable size selectable pie hat as in claim 9 and wherein:

a) said tuck has a free unattached end when lying against said inside surface of said crown.

12. An adjustable size selectable pie hat as in claim 1 and wherein:

a) said pair of segments each include a side extension including said tuck forming means.

13. An adjustable size selectable pie hat as in claim 12 and wherein:

a) One of said pair of segments side extension is longer than the other of said pair of side extensions, and said other of said pair of segments side extension being shorter than one of said pair of segments.

14. An adjustable size selectable pie hat as in claim 13 and wherein:

a) said longer side extension overlaps said other side extension.

15. An adjustable size selectable pie hat as in claim 14 and wherein:

a) said segment of said pair having said longer side extension has its base formed with a first short edge and a second long edge.

16. An adjustable size selectable pie hat as in claim 15 and wherein:

a) said first short edge is at an angle to said second long edge.

17. An adjustable size selectable pie hat as in claim 16 and wherein:

a) each of said side extensions of said pair of segments includes a top edge, and one side edge.

18. An adjustable size selectable pie hat as in claim 17 and wherein:

a) said one side edge of said longer side extension meets said short edge at an obtuse angle.

19. An adjustable size selectable pie hat as in claim 18 and wherein:

a) said second long edge is at an obtuse angle to said short base edge.

20. An adjustable size selectable pie hat as in claim 19 and wherein:

a) said segment of said other of said pair of segments having top and side edges, and b) said side edge of said shorter side extension of said other of said pair of segments meeting its base at substantially a right angle.

21. An adjustable size selectable pie hat as in claim 19 and wherein:

a) said longer side extension is folded over having a fold line, and b) said short edge and said long edge overlap each other from said fold line and form an acute angle with said fold line.

22. An adjustable size selectable hat having:

a) a crown having a front, a back, left and right sides, a center, and inside and outside surfaces;

b) said crown back including a slit extending upwardly a substantial distance toward said center of said crown and positioned between said left and right sides and formed by adjacent left and right side edges;

c) said back at said slit including left and right bases;

d) each of said left and right side edges having on their adjacent side edges tuck forming means including a tuck;

e) said adjacent left and right side edges being disconnected from said tuck to said left and right bases;

f) means for adjustably securing said left and right bases together to provide an overlap by said one of said left and right sides with the other of said left and right sides from said tuck to said left and right bases; and, g) whereby when said bases are secured together for selected size by said means for adjustably securing, said tuck will cause said overlap to lie flat and neat without bulge for said selected size regardless of size selected.

* * * * *

UNITED STATES PATENT AND TRADEMARK OFFICE

CERTIFICATE OF CORRECTION

PATENT NO. : 5,669,076
DATED : September 23, 1997
INVENTOR(S) : Sharon L. Steffy It is certified that error appears in the above-identified patent and that said Letters Patent is hereby corrected as shown below:

Column 2,
Line 21, insert -- , -- after "fasteners".
Line 63, delete -- fasteners --.
Line 64, insert -- , -- after "fasteners".
Line 67, insert -- V -- after "fasteners".
Line 24, change "2" to -- two --.
Line 67, insert -- to -- after "respect".

Column 3,
Line 4, insert -- of -- after "type".
Line 22, insert -- , -- after "36".
Line 53, change "to invention" to -- the invention --.

Claims,
Claim 13,
Subpart a), change "one of said pair of segments side extension is longer than the other of said pair of side extensions, and said other of said pair of segments side extension being shorter than one of said pair of segments" to -- said longer side extension overlaps said other side extension --.

Claim 14,
Subpart a), change "said longer side extension overlaps said other side extension" to -- said segment of said pair having said longer side extension has its base formed with a first short edge and a second long edge --.

Claim 15,
Subpart a), change "said segment of said pair having said longer side extension has its base formed with a first short edge and a second long edge" to -- said first short edge is at an angle to said second long edge --.

Claim 11,
Subpart a), change "said tuck has a free unattached end when lying against said inside surface of said crown" to -- said pair of segments each include a side extension including said tuck forming means --.

UNITED STATES PATENT AND TRADEMARK OFFICE

CERTIFICATE OF CORRECTION

PATENT NO. : 5,669,076
DATED : September 23, 1997
INVENTOR(S) : Sharon L. Steffy It is certified that error appears in the above-identified patent and that said Letters Patent is hereby corrected as shown below:

Claim 12,
In the preamble, change "1" to -- 11 --.
Subpart a), change "said pair of segments each include a side extension including said tuck forming means" to -- one of said pair of segments side extension is longer than the other of said pair of side extensions, and said other of said pair of segments side extension being shorter than one of said pair of segments --.

Claim 9,
Subpart a), change "said tuck has stitching lying at an angle to said radial stitching of said segments when said tuck is lying against the inside surface of said crown" to -- said angle is substantially an obtuse angle --.

Claim 10,
In the preamble, change "9" to -- 8+ --
Subpart a), change "said angle is substantially an obtuse angle" to -- said tuck has a free unattached end when lying against said inside surface of said crown --.

Claim 11,
In the preamble, change "9" to -- 1 --.

Claim 5,
Subpart a), line 2, change "sweatband" to -- sweat band --.

Claim 6,
In the preamble, change "3" to --1 --.
Subpart a), change " a segmented liner for said crown" to -- said tuck lies against said inside surface of said crown --.

Claim 7,
In the preamble, change "1" to -- 6 --.
Subpart a), change "said tuck lies against said inside surface of said crown" to -- said segments are interconnected by substantial radial stitching --.

Claim 8,
Subpart a), change "said segments are interconnected by substantial radial stitching" to -- said tuck has stitching lying at an angle to said radial stitching of said segments when said tuck is lying against the inside surface of said crown --.

UNITED STATES PATENT AND TRADEMARK OFFICE

CERTIFICATE OF CORRECTION

PATENT NO. : 5,669,076
DATED : September 23, 1997
INVENTOR(S) : Sharon L. Steffy It is certified that error appears in the above-identified patent and that said Letters Patent is hereby corrected as shown below:

Claim 21,
In the preamble, change "19" to -- 18 --.

Claim 22,
Line 1, subpart g), insert -- a -- after "for".

Claim 19,
Delete subpart a), and insert therefor:
-- a) said segment of said other of said pair of segments having top and side edges; and,
b) said side edge of said shorter side extension of said other of said pair of segments meeting its base at substantially a right angle --.

Claim 20,
In the preamble, change "19" to -- 3 --.
Delete subparts a) and b) and substitute therefor:
-- a segmented line for said crown. --.

Claim 16,
Subpart a), change "said first short edge is at an angle to said second long edge" to -- each of said side extensions of said pair of segments includes a top edge, and one side edge --.

Claim 17,
Subpart a), change "each of said side extensions of said pair of segments includes a top edge, and one side edge" to -- said one side edge of said longer side extension meets said short edge at an obtuse angle --.

UNITED STATES PATENT AND TRADEMARK OFFICE

CERTIFICATE OF CORRECTION

PATENT NO. : 5,669,076
DATED : September 23, 1997
INVENTOR(S) : Sharon L. Steffy It is certified that error appears in the above-identified patent and that said Letters Patent is hereby corrected as shown below:

Claim 18,
Subpart a), change "said one side edge of said longer side extension meets said short edge at an obtuse angle" to -- said second long edge is at an obtuse angle to said short base edge --.

Signed and Sealed this

Thirteenth day of November, 2001

*Attest:*

Nicholas P. Godici

NICHOLAS P. GODICI
*Acting Director of the United States Patent and Trademark Office*

*Attesting Officer*